United States Patent [19]

Brod et al.

[11] Patent Number: 4,891,145

[45] Date of Patent: Jan. 2, 1990

[54] LUBRICATING OIL COMPOSITION

[75] Inventors: Ramah J. Brod, Marcham, Nr. Abingdon; Robert D. Tack, Oxford; Kenneth Lewtas, Wantage, all of United Kingdom; Robert L. Elliott, Baton Rouge, La.

[73] Assignee: Exxon Chemical Patents Inc., Linden, N.J.

[21] Appl. No.: 823,678

[22] Filed: Jan. 29, 1986

[30] Foreign Application Priority Data

Jan. 31, 1985 [GB] United Kingdom ..... 8502458

[51] Int. Cl.[4] ..... C10M 145/38

[52] U.S. Cl. ..... 252/52 A; 252/56 R

[58] Field of Search ..... 252/52 A, 56 R

[56] References Cited

U.S. PATENT DOCUMENTS

| | | | |
|---|---|---|---|
| 45,209 | 2/1882 | Ostyn . | |
| 61,895 | 10/1882 | Tack et al. . | |
| 1,204,644 | 1/1860 | Elliot et al. . | |
| 2,299,397 | 8/1876 | Akoun et al. . | |
| 2,719,125 | 11/1955 | Roberts | 252/46.7 |
| 2,719,126 | 11/1955 | Fields et al. | 252/47 |
| 2,892,793 | 6/1959 | Stewart et al. | 252/56 |
| 2,944,973 | 7/1960 | Langer et al. | 252/17.5 |
| 3,004,917 | 10/1961 | Fefer | 252/33.4 |
| 3,087,932 | 4/1963 | Little, Jr. | 260/302 |
| 3,124,531 | 3/1964 | Whetzel, Jr. et al. | 252/52 A |
| 3,184,413 | 5/1965 | Furey et al. | 252/56 |
| 3,236,771 | 2/1966 | Matson | 252/32.7 |
| 3,275,555 | 9/1966 | Waight et al. | 252/54.6 |
| 3,296,138 | 1/1967 | Cupper et al. | 252/49.9 |
| 3,390,089 | 6/1968 | Tirtiaux et al. | 252/56 |
| 3,442,808 | 5/1969 | Traise et al. | 252/49.6 |
| 3,589,923 | 6/1971 | Stein | 252/52 A |
| 3,702,300 | 11/1972 | Coleman | 252/51.5 |
| 3,762,888 | 10/1973 | Kober et al. | 44/62 |
| 3,821,236 | 6/1974 | Ripple | 260/302 SD |
| 3,904,537 | 9/1975 | Ripple | 252/47.5 |
| 3,919,097 | 11/1975 | Park | 252/52 A |
| 3,961,916 | 6/1976 | Ilnyckyj et al. | 44/62 |
| 3,965,017 | 6/1976 | Bumop et al. | 252/52 A |
| 3,966,625 | 6/1976 | Tanizaka et al. | 252/52 A |
| 4,088,589 | 5/1978 | Rossi et al. | 252/56 R |
| 4,097,387 | 6/1978 | Caspari | 252/47.5 |
| 4,107,059 | 8/1978 | King et al. | 252/28 |
| 4,136,043 | 1/1979 | Davis | 252/47.5 |
| 4,151,069 | 4/1979 | Rossi | 208/33 |
| 4,188,299 | 2/1980 | Caspari | 252/46.4 |
| 4,229,311 | 10/1980 | Wenzel et al. | 252/50 |
| 4,240,916 | 12/1980 | Rossi | 252/56 |
| 4,245,004 | 1/1981 | Login et al. | 252/52 A |
| 4,375,973 | 3/1983 | Rossi et al. | 44/62 |
| 4,464,182 | 8/1984 | Tack et al. | 44/62 |
| 4,470,914 | 9/1984 | Thir et al. | 252/52 A |
| 4,518,512 | 5/1985 | Kanamori | 252/52 A |

FOREIGN PATENT DOCUMENTS

| | | | |
|---|---|---|---|
| 711364 | 6/1954 | United Kingdom | 91/ |

*Primary Examiner*—William R. Dixon, Jr.
*Assistant Examiner*—Jerry D. Johnson
*Attorney, Agent, or Firm*—Vivienne T. White; Robert A. Maggio

[57] ABSTRACT

The invention concerns a lubricating oil containing less than 3 wt. % of a mixture of (1) a lubricating oil pour depressant and (2) a polyoxyalkylene ester, ether, ester/ether or mixture thereof containing one or more $C_{10}$ to $C_{30}$ alkyl groups and polyoxyalkylene glycol group of molecular weight 100 to 5000, the alkylene group of said polyoxyalkylene glycol containing from 1 to 4 carbon atoms. The pour depressant can for example be a vinyl acetate copolymer, a polyalkylacrylate, a polyalkylmethacrylate or an esterified olefin/maleic anhydride copolymer.

9 Claims, No Drawings

LUBRICATING OIL COMPOSITION

This invention relates to lubricating oil compositions having low pour points.

It is known that the pour points of lubricating oils can be depressed by the addition of additives such as copolymers of fumarate esters and vinyl acetate. It is also known, for example from U.S. Pat. No. 4,088,589, that the pour point of lubricating oils can be lowered by adding two or more pour depressants to the oil. In such cases however the cost has been appreciably greater than using only one depressant because the total weight of pour depressants has been substantially greater than when only one pour depressant has been used.

We have surprisingly found a combination of additives which when added to a lubricating oil can provide a considerable reduction in pour point over that achieved by a fumarate ester/vinyl acetate copolymer at substantially no greater cost. Also in some cases the viscosity index is improved.

According to this invention a lubricating oil composition comprises a lubricating oil and (1) a lubricating oil pour depressant, for example a vinyl acetate copolymer, a polyalkylacrylate, a polyalkylmethacrylate or an esterified olefin/maleic anhydride copolymer in which the esters are derived from a $C_6$ to $C_{22}$ linear alcohol, and (2) a polyoxyalkylene ester, ether, ester/ether or a derivative thereof or a mixture of one or more thereof containing one or more $C_{10}$ to $C_{30}$ saturated alkyl groups and a polyoxyalkylene glycol of molecular weight 100 to 5000, the alkylene group of said polyoxyalkylene glycol containing from 1 to 4 carbon atoms, the total weight of (1) and (2) being less than 3% by weight based on the weight of lubricating oil.

Suitable lubricating oils include mineral lubricating oils, synthetic lubricating oils and mixtures thereof. The synthetic oils will include diester oils such as di(2-ethylhexyl) sebacate, azelate and adipate; complex ester oils such as those formed from dicarboxylic acids, glycols and either monobasic acids or monohydric alcohols; silicone oils; sulphide esters; organic carbonates; hydrocarbon oils and other known synthetic oils.

One may also use lubricating oils prepared from vacuum distillation fractions or residues of the vacuum distillation of crude mineral oils. These oils can also be prepared by hydrocracking mineral oil and subsequently hydrogenating the products with the object of increasing their oxidative stability which provides a heavy hydrotreated blending component.

The lubricating oils are generally crackcase lubricants for internal combustion engines and the additives of this invention may be used in the oils having the final viscosity of OW to 50 according to ASE J 300 as issued by the American Society of Automotive Engineers.

The lubricating oil pour depressant (1) may be a polymer and may be derived from an ester of the general formula:

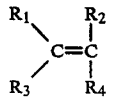

wherein $R_1$ and $R_2$ similar or dissimilar are hydrogen or a $C_1$ to $C_4$ alkyl group, e.g. methyl, $R_3$ is RCO.O— or RO.CO—, where R is alkyl, preferably $C_6$ to $C_{22}$ alkyl and $R_4$ is hydrogen, $R_2$ or $R_3$. Examples of unsaturated esters are $C_6$ to $C_{22}$ alkyl fumarates (and maleates), acrylates, methacrylates, itaconates, citraconates and vinyl esters.

The acid mono or di- ester monomers may be copolymerized with various amounts, e.g., 0 to 70 mole %, of other unsaturated esters or olefins. Such other esters include short chain alkyl esters having the formula:

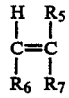

where $R_5$ is hydrogen or a $C_1$ to $C_4$ alkyl group, $R_6$ is $COOR_8$ or $OOCR_8$ where $R_8$ is a $C_1$ to $C_5$ alkyl group branched or unbranched, and $R_7$ is $R_6$ or hydrogen. Examples of these short chain esters are methacrylates, acrylates, fumarates (and maleates) and vinyl esters. More specific examples include methyl methacrylate, isopropenyl acrylate and isobutyl acrylate, the vinyl esters such as vinyl acetate and vinyl proprionate being preferred.

The preferred polymers contain from 40 to 60% (mole/mole) of a $C_6$ to $C_{22}$ dialkyl fumarate and 60 to 40% (mole/mole) of vinyl acetate.

The fumarate from which the copolymers are derived has the general formula

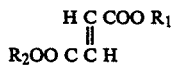

where $R_1$ and $R_2$ which are the same or different may be alkyl groups of 6 to 22 carbon atoms, preferably 10 to 16 carbon atoms the average number of carbon atoms in $R_1$ and $R_2$ being 13 to 15. These fumarates can be prepared by esterification of fumaric acid with $C_6$ to $C_{22}$ alcohol mixtures.

The fumarates are copolymerised with vinyl alcohol esters of $C_2$ to $C_{22}$, preferably $C_2$ to $C_8$, e.g. $C_2$ to $C_5$ alkanoic acids such as acetic acid, proprionic acid etc. The molar ratio of vinyl alkanoate to fumarate may be from about 0.5 to 1.5, preferably 0.6 to 1.3, e.g. about 0.9.

The ester polymers are generally prepared by polymerising the ester monomers in a solution of a hydrocarbon solvent such as heptane, benzene, cyclohexane, or white oil, at a temperature generally in the range of from 20° C. to 150° C. and usually promoted with a peroxide or azo type catalyst such as benzoyl peroxide or azodiisobutyronitrile under a blanket of an inert gas such as nitrogen or carbon dioxide in order to exclude oxygen. The polymer may be prepared under pressure in an autoclave or by refluxing.

The unsaturated dicarboxylic acid mono or di-ester can also be copolymerized with an alpha-olefin. However, it is usually easier to polymerize the olefin with the dicarboxylic acid or its anhydride, and then esterify with 1 to 2 molar proportions of alcohol per mole of dicarboxylic acid or anhydride. As an illustration, the ethylenically unsaturated di-carboxylic acid or anhydride or derivative thereof is reacted with a $C_{14}$ to $C_{16}$ olefin, by mixing the olefin and acid, or anhydride, e.g. maleic anhydride or derivative usually in about equimolar amounts, and heating to a temperature of about 60° C. to 100° C. when azodiisobutyronitrile is used or from 100° to 150° C. when ditertiary butyl peroxide is used. A free radical polymerization promoter such as t-butyl hydroperoxide or di-t-butyl peroxide is normally used. The resulting copolymer thus prepared is then esterified with alcohol.

The preferred polyoxyalkylene esters, ethers or ester/ethers have the formula $$R—O—(A)—O—R^1$$

where R and $R^1$ are the same or different and may be

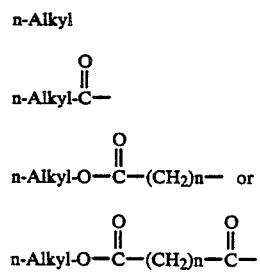

the alkyl group being substantially linear and saturated and containing 10 to 30 carbon atoms. In this formula A represents the polyoxyalkylene segment of the glycol in which the alkylene group has 1 to 4 carbon atoms such as a polyoxymethylene, polyoxyethylene or polyoxytrimethylene moiety which is preferably substantially linear; some degree of branching with lower alkyl side chains (such as in polyoxypropylene glycol) may be tolerated. n is an integer.

The polyoxyalkylene glycol may be substituted or may be interrupted by for example a Nitrogen atom obtained by condensing an amine or an alkanolamine with the glycol.

Suitable glycols generally are the substantially linear polyethylene glycols (PEG) and polypropylene glycols (PPG) having a molecular weight of about 100 to 5,000 preferably about 200 to 2,000 and more preferably 200 to 800.

Esters are the preferred additives for use in this invention and fatty acids containing about 10–30 carbon atoms are useful for reacting with the glycols to form the ester additives and it is especially preferred to use a $C_{18}$–$C_{24}$ fatty acid, especially behenic acid or mixtures of stearic and behenic acids. The esters may also be prepared by esterifying polyethoxylated fatty acids or polyethoxylated alcohols, it is preferred that the alkyl group in the fatty acid be substantially linear.

One may use not only the polyoxyalkylene diesters, diethers, ether/esters and mixtures thereof but also the monoethers and monoesters. For example one may use the stearic or behenic diesters of polyethylene glycol, polypropylene glycol or polyethylene/polypropylene glycol mixtures. One could also use esters derived from mixed alcohols, e.g. from ethoxylated fatty alcohols and from the Tweens (e.g. ethoxylated sorbitan tristearates).

A particularly preferred ester for use as component (2) is the dibehenate ester of polyethylene glycol of molecular weight about 400.

The total weight of components (1) and (2) is less than 3%, preferably less than 2 wt. % and more preferably 0.01 to 0.25 wt % based on the total weight of the lubricating oil composition. In particular the weight of component (1) is preferably 0.01 to 0.2 wt % especially 0.02 to 0.1 wt % and the weight of component (2) is preferably 0.00001 to 0.0002 wt %, especially 0.00005 to 0.0001 wt %, the percentages being based on the total weight of the lubricating oil composition.

With this combination of components (1) and (2) lubricating oils having low pour points can be prepared. Accordingly this invention also provides the combination of components (1) and (2) for use in depressing the pour point of lubricating oils or lubricating oil compositions, components (1) and (2) being as defined above. It is preferred that the amount of component (1) be 500 to 1500 times, preferably 800 to 1200 times, that of component (2).

The lubricating oil may also include conventional lubricating oil additives.

The lubricating compositions of the present invention may and usually will contain other traditional lubricant additives such as rust inhibitors such as lecithin, sorbitan mono-oleate, dodecyl succinic anhydride or ethoxylated alkyl phenols; with fumaric acid esters of coconut oil alcohols; viscosity index improvers such as olefin copolymers, polymethacrylates; etc.

Dispersancy can be provided by a traditional lubricating oil ashless dispersant compounds such as derivatives of long chain hydrocarbon substituted carboxylic acids in which the hydrocarbon groups contains 50 to 400 carbon atoms. These will generally be a nitrogen containing ashless dispersant having a relatively high molecular weight aliphatic hydrocarbon oil solubilising group attached thereto or an ester of a succinic acid/anhydride with a high molecular weight aliphatic hydrocarbon attached thereto and derived from monohydric and polyhydric alcohols, phenols and naphthols.

Another class of nitrogen containing dispersant which may be used are those containing Mannich base or Mannich condensation products as they are known in the art. Such Mannich condensation products generally are prepared by condensing about 1 mole of an alkyl substituted phenol with about 1 to 2.5 moles of formaldehyde and about 0.5 to 2 moles polyalkylene polyamine as disclosed, e.g. in U.S. Pat. No. 3,442,808. Such Mannich condensation products may include a long chain, high molecular weight hydrocarbon on the phenol group or may be reacted with a compound containing such a hydrocarbon, e.g. alkenyl succinic anhydride as shown in said aforementioned U.S. Pat. No. 3,442,808 patent.

The most commonly used dicarboxylic acid is alkenyl succinic anhydride wherein the alkenyl group contains about 50 to about 400 carbon atoms.

Alternatively the ashless dispersants may be esters derived from any of the aforesaid long chain hydrocarbon substituted carboxylic acids and from hydroxy compounds such as monohydric and polyhydric alcohols or aromatic compounds such as phenols and naphthols etc. The polyhydric alcohols are the most preferred hydroxy compound and preferably contain from 2 to about 10 hydroxy radicals, for example, ethylene glycol, diethylene glycol, triethylene glycol, tetraethylene glycol, diproplyene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol.

Alternatively this dispercancy may be provided by 0.3 to 10% of a polymeric Viscosity Index improver dispersant.

Examples of suitable Viscosity Index improvers dispersants include:

(a) polymers comprised of $C_4$ to $C_{24}$ unsaturated esters of vinyl alcohol or $C_3$ to $C_{10}$ unsaturated mono- or di-carboxylic acid with unsaturated nitrogen containing monomers having 4 to 20 carbons (b) polymers of $C_2$ to $C_{20}$ olefin with unsaturated $C_3$ to $C_{10}$ mono- or di-carboxylic acid neutralised with amine, hydroxy amine or alcohols.

(c) polymers of ethylene with a $C_3$ to $C_{20}$ olefin further reacted either by grafting $C_4$ to $C_{20}$ unsaturated nitrogen containing monomers thereon or by grafting an unsaturated acid onto the polymer backbone and then reacting said carboxylic acid groups with amine, hydroxy amine or alcohol.

In these polymers the amine, hydroxy amine or alcohol "mono- or poly-hydric" may be as described above in relation to the ashless dispersants compounds.

Magnesium and calcium containing additives are also frequently included in lubricating compositions. These may be present for example as the metal salts of sulphonic acids, alkyl phenols, sulphurised alkyl phenols, alkyl salicylates, naphthenates, and other soluble mono- and di-carboxylic acids.

The lubricating composition of the present invention may also include copper lead bearing corrosion inhibitors. Typical such compounds are the thiadiazole polysulphides containing from 5 to 50 carbon atoms, their derivatives and polymers thereof. Preferred materials are the derivatives of 1,3,4 thiadiazoles such as those described in U.S. Patents 2,719,125, 2,719,126 and 3,087,932 especially preferred is the compound 2,5 bis (t-octadithio)-1,3,4 thiadiazole commercially available as Amoco 150. Other similar materials also suitable are described in U.S. Patents 3,821,236, 3,904,537, 4,097,387, 4,107,059, 4,136,043, 4,188,299 and 4,193,882.

The additives are preferably supplied as a concentrate which may also contain other additives, the concentrate preferably being solutions containing from 5 to 60 wt. % of the combination of components (1) and (2) generally in the ratio desired in the lubricating oil into which the concentrate is incorporated. Such concentrates are within the scope of the present invention.

EXAMPLE 1

To a mineral lubricating oil, Stanco 150 were added varying amounts of a vinyl acetate/di alkyl fumarate copolymer. Also varying amounts of this copolymer together with varying amounts of a dibehenate ester of polyethylene glycol of MW 600 were also added to Stanco 150.

TEST METHOD

The pour points were determined in each case and from the following table it can be seen that there is synergy between the copolymer and the dibehenate ester and that the addition of very small quantities of the dibehenate ester enable one to achieve effective pour point depression at much lower treat rates than with the copolymer alone.

TABLE 1

| Pour Points in Stanco 150, °C. | | | | |
|---|---|---|---|---|
| Treat rate for PEG ester* | | 0 | 50 ppm | 100 ppm |
| Treat rate for F-VA copolymer** | 0 | −9, −12<br>−12, −12 | −15 | −12 |
| | 0.02 wt. % | −9, −9 | −18, −18 | −18 |
| | | −15 | −21 | −21, −21 |
| | 0.04 wt. % | −15, −21<br>−24 | −21<br>−24, −24 | −24, −24 |
| | 0.08 wt. % | −24, −24 | −24, −27 | −21, −27 |

*Polyethylene glycol (MW 600) dibehenate

**A fumarate-vinyl acetate copolymer the fumarate ester being derived from an alcohol mixture of about 9 wt. % $C_8$, 11 wt. % $C_{10}$, 35 wt. % $C_{12}$, 30 wt. % $C_{14}$, 10 wt. % $C_{16}$ and 4 wt. % $C_{18}$ alcohols.

EXAMPLE 2

To a mineral lubricating oil, Stanco 150 was added a conventional lubricating oil pour depressant, the copolymer of 1 mole of a dialkyl fumarate with 1 mole of vinyl acetate, the alcohols from which the fumarate was derived being $C_{12}/C_{13}$ (42/58%) alcohols, these alcohols being derived from linear olefins (81% normal alcohols).

In three tests 0.01 wt. %, 0.02 wt. % and 0.04 wt. % of this pour depressant was added and the ASTM (°C.) pour point measured.

These tests were repeated but with the addition also of 0.01 wt. % of the polyethylene glycol (MW 400) di stearate/behenate ester. As can be seen from the following Table 2 a considerable reduction in the pour point was achieved when the polyethylene glycol ester was also added.

TABLE 2

| | Pour Points °C. |
|---|---|
| Vinyl acetate/dialkyl fumarate copolymer | |
| 0.01% copolymer | −6 |
| 0.02% copolymer | −12 |
| 0.04% copolymer | −6 |
| Vinyl acetate/dialkyl fumarate copolymer + 0.01% polyethylene glycol ester | |
| 0.01% copolymer | −18 |
| 0.02% copolymer | −21 |
| 0.04% copolymer | −21 |

We claim:

1. A lubricating oil composition adapted for use in the crankcase of an internal combustion engine comprising a lubricating oil, dispersant; and (1) a polymeric, ester containing, lubricating oil pour depressant derived from at least one unsaturated esterifiable monomer; and (2) at least one member selected from the group consisting of polyoxyalkylene ether, ester/ether and derivatives thereof containing at least one $C_{10}$ to $C_{30}$ saturated alkyl group, and a polyoxyalkylene glycol group of molecular weight 100 to 5000, the alkylene group of said polyoxyalkylene glycol containing from 1 to 4 carbon atoms; the total weight of (1) and (2) being less than 3% by weight based on the weight of lubricating oil composition.

2. A composition according to claim 1 wherein the lubricating oil pour depressant is a polymer derived from an ester of the formula

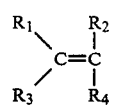

wherein $R_1$ and $R_2$ which may be similar or dissimilar are hydrogen or a $C_1$ to $C_4$ alkyl group, $R_3$ is RCOO— or ROCO— where R is alkyl and $R_4$ is hydrogen, $R_2$ or $R_3$.

3. A composition according to claim 1 wherein the ester pour depressant (1) is a $C_{10}$ to $C_{12}$ alkyl fumarate.

4. A composition according to claim 1 wherein the lubricating oil pour depressant (1) is derived from vinyl acetate.

5. A composition according to claim 1 wherein the lubricating oil pour depressant is a copolymer of 40 to 60 mole % $C_6$ to $C_{22}$ dialkyl fumarate and 60 to 40 mole % vinyl acetate.

6. A composition according to claim 1 wherein the ether or ester/ether (2) is derived from a polyethylene glycol or polypropylene glycol having a molecular weight of from 200 to 2000.

7. A composition according to claim 1 in which the $C_{10}$ to $C_{30}$ alkyl group is a linear alkyl group.

8. A composition according to claim 1 wherein the total weight of components (1) and (2) is 0.01 to 0.25 wt. % based on the total weight of the lubricating oil composition.

9. An additive concentrate adapted for use in a crankcase lubricating oil composition wherein the total weight of the additives (1) and (2) of the concentrate being sufficient to achieve, in the final lubricating oil composition, a concentration of less than 3% by weight based on the weight of said final lubricating oil composition; said additive concentrate comprising a solution containing from 5 to 60 wt. % of a mixture of lubricating oil, dispersant, and (1) a polymeric, ester containing, lubricating oil pour depressant derived from at least one unsaturated, esterifiable, monomer; and (2) at least one member selected from the group consisting of a polyoxyalkylene ether, ester/ether and derivatives thereof containing at least one $C_{10}$ to $C_{30}$ saturated alkyl group and a polyoxyalkylene glycol group of molecular weight 100 to 5000, the alkylene group of said polyoxyalkylene glycol containing from 1 to 4 carbon atoms.

* * * * *